US007304027B1

(12) United States Patent
Marshall et al.

(10) Patent No.: US 7,304,027 B1
(45) Date of Patent: Dec. 4, 2007

(54) PHASE-STABLE CONCENTRATED FABRIC SOFTENERS CONTAINING BORATES

(75) Inventors: Michael Marshall, Scottsdale, AZ (US); Thorsten Bastigkeit, Scottsdale, AZ (US); Joan Bergstrom, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 0 days.

(21) Appl. No.: 11/496,890

(22) Filed: Jul. 31, 2006

(51) Int. Cl.
*C11D 7/04* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS 4,155,855 A 5/1979 Goffinet et al.
4,157,307 A 6/1979 Jaeger et al.
4,233,164 A 11/1980 Davis
4,326,965 A 4/1982 Lips et al.
4,556,502 A 12/1985 Blackmore et al.
4,661,269 A 4/1987 Trinh et al.
4,772,404 A 9/1988 Fox et al.
4,855,072 A 8/1989 Trinh et al.
4,994,193 A 2/1991 Wahl
5,183,580 A 2/1993 Lew et al.
5,468,398 A 11/1995 Farooq et al.
5,490,944 A 2/1996 Suazon
5,501,806 A 3/1996 Farooq et al.
5,656,585 A 8/1997 Grandmaire et al.
5,747,108 A 5/1998 Farooq et al.
5,747,109 A 5/1998 Farooq et al.
5,767,052 A 6/1998 Shaw, Jr. et al.
6,218,354 B1 4/2001 Demeyere et al.
6,303,563 B1 * 10/2001 De Buzzaccarini et al. 510/504
6,559,117 B1 5/2003 Severns et al.

FOREIGN PATENT DOCUMENTS

WO WO 2006/125147 * 11/2006

* cited by examiner

*Primary Examiner*—John R. Hardee
(74) *Attorney, Agent, or Firm*—Paul A. Pappalardo

(57) ABSTRACT

Phase-stable concentrated liquid fabric softener compositions having controlled viscosity are possible through the use of borate salts as processing aid, stabilizer and viscosity control agent.

7 Claims, No Drawings

PHASE-STABLE CONCENTRATED FABRIC SOFTENERS CONTAINING BORATES

FIELD OF INVENTION

The present invention relates to concentrated liquid fabric softeners. More specifically, the invention relates to concentrated liquid fabric softeners where pourability and phase stability are improved by incorporating borate salts.

BACKGROUND

Liquid fabric treatment compositions suitable for fabric softening and static control during the laundry process are well known in the art and widespread in commercial success. These liquid fabric treatment compositions typically contain quaternary ammonium cationic surfactants (commonly referred to as quats) that provide fabric-softening and anti-static benefit during the laundry rinse cycle. The quaternary fabric conditioning agents, often comprising long chain fatty alkyl groups, tend to be water-insoluble, making it difficult to produce a stable concentrated liquid product with anything more than about 10% quaternary actives. For many consumer and institutional cleaning products, it is desirable to market concentrated products in order to reduce shipping, warehousing and handling cost, to reduce plastic packaging waste in the environment, and to make product that is easier to pick up and use by the consumer. Although it is relatively simple to concentrate laundry detergents into stable highly active compositions, there are not many practical methods to prepare concentrated liquid fabric softener compositions with high levels of quaternary and still maintain both phase stability and control of the overall viscosity such that the product may be easily poured.

Many of the various solutions to the problem of preparing concentrated yet stable and pourable liquid fabric softener compositions have not been completely satisfactory. For example, electrolytes such as calcium chloride have been used to control viscosity, however addition of up to about 2000 ppm $CaCl_2$ does nothing more than allow a few more percent active quaternary to be added to the formula. This is exemplified in U.S. Pat. No. 3,681,241 (Rudy at al.) wherein formulations comprising only up to about 12% active quaternary are possible. This is also exemplified in U.S. Pat. No. 4,772,404 (Fox et al.) where formulas having up to 15% quaternary blend (Varisoft 222LM and Adogen 442 in a critical ratio) are stabilized with triethanolammonium citrate and 0.09% calcium chloride. Another approach has been to combine fabric "softener" and fabric "substantive" agents. For example U.S. Pat. Nos. 4,155,855 (Goffinet, et al.), 4,157,307 (Jaeger et al.) and 4,855,072 (Trinh et al), describe combination of fabric softening and fabric substantive agents, wherein the fabric substantive agent is a quaternary imidazolinium salt. However, even though the compositions may contain as much as 25-50% of a blend of these two quaternary materials, only the softening agent (a conventional quaternary) confers the softening and antistatic benefit to the fabric.

Other methods to stabilize concentrated fabric softener compositions having high levels of quaternary actives utilize additional surfactants, solvents or polymers. For example, as described in U.S. Pat. No. 4,326,965 (Lips et al.), stable formulas with up to 40% active quaternary are possible when incorporating 4-25% polymer having MW greater than 400. U.S. Pat. No. 4,556,502 (Blackmore et al.) describes concentrated fabric softener formulations with up to 40% active quaternary if stabilized with greater than 0.5% amphoteric surfactants and 5-30% alkanol solvent. Lastly, U.S. Pat. No. 4,233,164 (Davis) describes stabilization of 2-11% quaternary active formulations through the use of 1-5% nonionic surfactant.

Accordingly, fabric softeners having high levels of common quaternary ammonium cationic surfactants that remain creamy, phase-stable and pourable, without the addition of costly, extraneous and inactive ingredients are highly desirable.

SUMMARY OF THE INVENTION

It has now been discovered that incorporation of borate salts stabilizes relatively high concentrations of quaternary actives in aqueous fabric softener compositions. The present invention provides a liquid fabric softener of high quaternary level that has controlled viscosity, is phase-stable and creamy in appearance, through the use of borates. Although calcium chloride and other electrolytes are known to stabilize quaternary fabric softener compositions, the value of using borates to stabilize liquid fabric softener compositions has hitherto not been recognized anywhere in the art.

For example, a phase-stable fabric softener composition in accordance with a preferred embodiment of the present invention comprises from about 0.01% to about 2% by weight of sodium tetraborate decahydrate, from about 3% to about 30% of ester quat, from about 0.05% to about 0.5% of citric acid, with optional antifoam, preservative, dye and fragrance, and the remainder water.

DETAILED DESCRIPTION OF THE INVENTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

That said, the present invention relates to a concentrated aqueous fabric softener composition that is highly effective for softening and providing antistatic benefit to laundered fabrics. The concentrated fabric softener compositions of the present invention have controlled viscosity such that the product is easily handled by the consumer, and have creamy appearance and are pourable. Most importantly, the concentrated fabric softener compositions of the present invention are stabilized through the use of borate salts.

The present invention relates to fabric softener compositions that minimally comprise quaternary surfactants, a borate salt, a proton-donating agent and water, and that optionally comprise antifoams, preservatives, dyes and fragrances.

The Quaternary Surfactant:

In accordance with various embodiments of the present invention, the laundry fabric softener compositions comprise a quaternary ammonium cationic surfactant. For brevity, these cationic materials will be referred to as quaternary surfactants with the understanding that they are quaternized nitrogen species (i.e., cationic) and necessarily have an anionic counterion. In this regard, a variety of quaternary surfactants may be utilized, however acyclic quaternary surfactants are preferred. For example, useful quaternary synthetic surfactants that are acyclic include linear alkyl, branched alkyl, hydroxyalkyl, oleylalkyl, acyloxyalkyl, diamidoamine, or diester quaternary ammonium compounds. The preferred quaternary surfactants for use in the present invention are the ester and diester quaternary surfactants and the diamidoamine quaternary blends. Cyclic quaternary materials such as the imidazolines are less preferred in the present invention. The quaternary surfactant in accordance with a preferred embodiment is at a level from about 1% to about 40% by weight of the fabric softener composition, preferably from about 10% to about 30% and most preferably at a level of from about 15% to about 25%.

Examples of acyclic quaternary surfactant fabric-softening components useful in the present invention are shown by the general formulae (I) and (II):

(I)

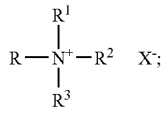

(II)

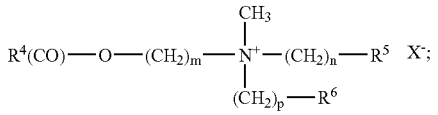

wherein for general formula (I), R and $R^1$ are individually selected from the group consisting of $C_1$-$C_4$ alkyl, benzyl, and $—C_2H_4O)_xZ$ where x has a value from 1 to 20 and Z is hydrogen or $C_1$-$C_3$ alkyl; $R^2$ and $R^3$ are each a $C_8$-$C_{30}$ alkyl or $R^2$ is a $C_8$-$C_{30}$ alkyl and $R^3$ is selected from the group consisting of $C_1$-$C_5$ alkyl, benzyl, and $—(C_2H_4O)_x—H$ where x has a value from 2 to 5; and where $X^-$ represents an anion selected from the group consisting of halides, methyl sulfate, ethyl sulfate, methyl phosphate, acetate, nitrate or phosphate ion and mixtures thereof. Specific examples of quaternary surfactants described within the general formula (I) include alkyltrimethylammonium compounds, dialkyldimethylammonium compounds and trialkylmethylammonium compounds including but not limited to, tallow trimethyl ammonium chloride, ditallow dimethyl ammonium chloride, ditallow dimethyl ammonium methyl sulfate, dihexadecyl dimethyl ammonium chloride, di-(hydrogenated tallow) dimethyl ammonium chloride, dioctadecyl dimethyl ammonium chloride, dieicosyl dimethyl ammonium chloride, didocosyl dimethyl ammonium chloride, di-(hydrogenated tallow) dimethyl ammonium methyl sulfate, dihexadecyl dimethyl ammonium acetate, ditallow dipropyl ammonium phosphate, ditallow dimethyl ammonium nitrate, di-(coconut-alkyl) dimethyl ammonium chloride, cetyltrimethylammonium chloride, stearyltrimethylammonium chloride, distearyldimethylammonium chloride, lauryldi-methylammonium chloride, and tricetylmethylammonium chloride, along with other quaternary compounds such as trihydroxyethylmethylammonium methosulfate, lauryldimethylbenzylammonium chloride, and the like.

Quaternary surfactants of the formula (II) are known as ester quats. Ester quats are notable for excellent biodegradability. In the formula (II), $R^4$ represents an aliphatic alkyl radical of 12 to 22 carbon atoms which has 0, 1, 2 or 3 double bonds; $R^5$ represents H, OH or $O—(CO)R^7$, $R^6$ represents H, OH or $O(CO)R^8$ independently of $R^5$, with $R^7$ and $R^8$ each being independently an aliphatic alkyl radical of 12 to 22 carbon atoms which has 0, 1, 2 or 3 double bonds. m, n and p are each independently 1, 2 or 3. $X^-$ may be a halide, methyl sulfate, ethyl sulfate, methyl phosphate, nitrate, acetate or phosphate ion and also mixtures thereof. Useful are compounds wherein $R^5$ is $O—(CO)R^7$ and $R^4$ and $R^7$ are alkyl radicals having 16 to 18 carbon atoms, particularly compounds wherein $R^6$ also represents OH. Examples of compounds of the formula (II) are methyl-N-(2-hydroxyethyl)-N,N-di-(tallow acyloxyethyl)ammonium methyl sulfate, bis-(palmitoyl)-ethylhydroxyethyl methyl ammonium methyl sulfate or methyl-N,N-bis(acyloxyethyl)-N-(2-hydroxyethyl)ammonium methyl sulfate. In quaternary surfactants of the formula (II) which comprise unsaturated alkyl chains, preference is given to acyl groups whose corresponding fatty acids have an iodine number between 5 and 80, preferably between 10 and 60 and especially between 15 and 45 and also a cis/trans isomer ratio (in % by weight) of greater than 30:70, preferably greater than 50:50 and especially greater than 70:30. Commercially available examples are the methylhydroxyalkyldialkoyloxyalkylammonium methyl sulfates marketed by Stepan under the Stepantex® brand or the Cognis products appearing under Dehyquart® or the Degussa products appearing under Rewoquat®. Further ester quats of use in the present invention have the formulas; $[(CH_3)_2N^+(CH_2CH_2OC(O)—R)_2]X^-$ or $[(HOCH_2CH_2)(CH_3)N^+(CH_2CH_2OC(O)—R)_2]X^-$, where R=linear saturated or unsaturated alkyl radical of 11 to 19 and preferably 13 to 17 carbon atoms. In a particularly preferred embodiment the fatty acid residues are tallow fatty acid residues. $X^-$ represents either a halide, for example chloride or bromide, methyl phosphate, ethyl phosphate, methyl sulfate, ethyl sulfate, acetate, nitrate, phosphate and also mixtures thereof.

Further useful acyclic quaternary ammonium fabric-softening agents include the diester quats of the formula (III), obtainable under the name Rewoquat® W 222 LM or CR 3099, which provide stability and color protection as well as softness:

(III)

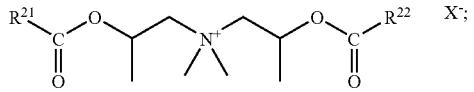

where $R^{21}$ and $R^{22}$ each independently represent an aliphatic radical of 12 to 22 carbon atoms which has 0, 1, 2 or 3 double bonds.

It is likewise possible to use amidoamine quaternary surfactants of the formula (IV)

(IV)

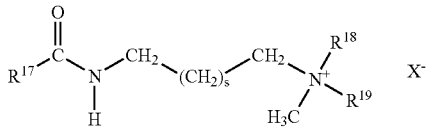

wherein $R^{17}$ may be an aliphatic alkyl radical having 12 to 22 carbon atoms with 0, 1, 2 or 3 double bonds, s can assume values between 0 and 5, $R^{18}$ and $R^{19}$ are, independently of one another, each H, $C_{1-4}$-alkyl or hydroxyalkyl. Preferred compounds are fatty acid amidoamines such as stearylamidopropyldimethylamine obtainable under the name Tego Amid® S18, or the 3-tallowamidopropyltrimethylammonium methyl sulfate obtainable under the name Stepantex® X 9124, which are characterized not only by a good conditioning effect, but also by color-transfer-inhibiting effect and in particular by their good biodegradability. Particular preference is given to alkylated quaternary ammonium compounds in which at least one alkyl chain is interrupted by an ester group and/or amido group, in particular N-methyl-N-(2-hydroxyethyl)-N,N-(ditallowacyloxyethyl)ammonium methyl sulfate and/or N-methyl-N-(2-hydroxyethyl)-N,N-(palmitoyloxyethyl)ammonium methyl sulfate.

In preferred embodiments, the concentrated liquid fabric softener compositions of the present invention comprise Rewoquat® WE-18-E-US (proprietary ester quat from Degussa), Incrosoft® T-90 from Croda, Stepantex® VA-90 from Stepan, or mixtures thereof, as the quaternary surfactants, preferably present from about 10% to about 30% by weight based on the entire composition.

The Borate Salt

As noted above and in accordance with various embodiments of the present invention, the liquid fabric softener composition comprises a borate salt to control viscosity and to stabilize the composition. The borate salt in the present invention may comprise any form of borate, including Borax® (Hydrated Sodium Borate) $Na_2O/2B_2O_3/1OH_2O$, Kernite (Hydrated Sodium Borate) $Na_2O/2B_2O_3/4H_2O$, Colemanite (Hydrated Calcium Borate) $2CaO/3B_2O_3/5H_2O$:CaO, Ulexite (Hydrated Sodium Calcium Borate) $Na_2O/2CaO/5B_2O_3/16H_2O$, Boracite $5MgO/MgC_{12}/7B_2O_3$, or mixtures thereof, with Borax® (sodium tetraborate decahydrate) being the preferred borate since it is readily available, reasonably priced and easy to handle in manufacturing environments. Useful in the present invention is 10 Mol (30/70 mesh) Borax®, which is >99% white crystalline sodium tetraborate decahydrate. The compositions of the present invention may comprise from about 0.01% to about 5.0% of a borate salt, depending on type of mineral and level of hydration. Referring now to an exemplary embodiment of a liquid fabric softener composition of the present invention, the sodium tetraborate decahydrate is used at a level of from about 0.01% to about 2.0% by weight, preferably at a level of from about 0.1% to about 0.3% and most preferably at about 0.2% by weight.

The Proton-Donating Agent

Proton-donating agents for use in the present invention may be either inorganic or organic acids, or mixtures thereof. For example, hydrochloric acid, sulfuric acid, and phosphoric acid are all useful inorganic proton-donating agents in the compositions of the present invention. Useful organic proton-donating agents include monocarboxylic acids, polycarboxylic acids, polymeric acids having a plurality of carboxylic, phosphate, sulfonate, and/or sulfate moieties, or mixtures thereof. In addition to acid moieties, the organic proton-donating agent may also contain other functional groups, for example, hydroxyl-groups and/or amino-groups. In addition, an organic acid anhydride can be used in a composition of the present invention as the organic proton-donating agent. Depending on the level of borate salt, and the type and acid strength of the proton-donating agent, the compositions of the present invention may comprise from about 0.01% to about 1.0% by weight of the proton-donating agent.

In one embodiment, the proton-donating agent comprises a monocarboxylic acid having a structure $RCO_2H$, wherein R is $C_{1-3}$ alkyl, hydroxy-$C_{1-3}$ alkyl, halo-$C_{1-3}$ alkyl, phenyl, or substituted phenyl. The monocarboxylic acid preferably has a water solubility of at least about 0.05%, by weight, at 25° C. The alkyl groups can be substituted with phenyl groups and/or phenoxy groups, and these phenyl and phenoxy groups can be substituted or unsubstituted.

Nonlimiting examples of monocarboxylic acids useful as the proton-donating agent in the fabric softener compositions of the present invention are acetic acid, propionic acid, hydroxyacetic acid, lactic acid, benzoic acid, phenylacetic acid, phenoxyacetic acid, zimanic acid, 2-, 3-, or 4-hydroxybenzoic acid, anilic acid, o-, m- or p-chlorophenylacetic acid, o-, m-, or p-chlorophenoxyacetic acid, and mixtures thereof. Additional substituted benzoic acids are disclosed in U.S. Pat. No. 6,294,186, incorporated herein by reference. Examples of substituted benzoic acids include, but are not limited to, salicyclic acid, 2-nitrobenzoic acid, thiosalicylic acid, 2,6-dihydroxybenzoic acid, 5-nitrosalicyclic acid, 5-bromosalicyclic acid, 5-iodosalicyclic acid, 5-fluorosalicylic acid, 3-chlorosalicylic acid, 4-chlorosalicyclic acid, and 5-chlorosalicyclic acid.

In another embodiment, the organic proton-donating agent comprises a polycarboxylic acid. The polycarboxylic acid may contain at least two, and up to four, carboxylic acid groups. The polycarboxylic acid also can contain hydroxyl or amino groups, in addition to substituted and unsubstituted phenyl groups. Preferably, the polycarboxylic acid has a water solubility of at least about 0.05%, by weight, at 25° C. Nonlimiting examples of polycarboxylic acids useful in the present invention include malonic acid, succinic acid, glutaric acid, adipic acid, pimelic acid, suberic acid, azelaic acid, sebacic acid, fumaric acid, maleic acid, tartaric acid, malic acid, maleic acid, citric acid, aconitic acid, and mixtures thereof.

The preferred polycarboxylic acid for use as the proton donating agent in the present invention is citric acid, and most preferably the citric acid is incorporated as the 50% active liquid since it is easy to handle and dust-free in a manufacturing plant. Preferably, the citric acid is present as the proton-donating agent in the present fabric softener composition from about 0.05% to about 0.5% actives basis by weight, (or from 0.1% to about 1.0% of the 50% actives citric acid liquid, by weight), based on the entire composition.

Anhydrides of polycarboxylic and monocarboxylic acids also are organic proton-donating agents useful in the present compositions. Preferred anhydrides are anhydrides of polycarboxylic acids. At least a portion of the anhydride is hydrolyzed to a carboxylic acid because of the pH of the composition.

In another embodiment, the organic proton-donating agent comprises a polymeric carboxylic acid, a polymeric sulfonic acid, a sulfated polymer, a polymeric phosphoric acid, and mixtures thereof. The polymeric acid has a molecular weight of about 500 g/mol to 10,000,000 g/mol, and includes homopolymers, copolymers, and mixtures thereof. The polymeric acids are not crosslinked or only very minimally crosslinked. The polymeric acids therefore are water-soluble or at least water dispersible. One preferred polymeric acid is a polyacrylic acid, either a homopolymer or a copolymer, for example, a copolymer of acrylic acid and an alkyl acrylate and/or alkyl methacrylate. Another preferred polymeric acid is a homopolymer or a copolymer of methacrylic acid.

Optional Ingredients

1. Antifoam

Antifoam is an optional ingredient for the compositions of the present invention. Any silicone emulsion antifoam typically used for aqueous compositions finds use in the present invention. Most useful are the antifoam emulsions available from Dow Corning. The preferred silicone antifoam for use in the present invention is Dow Corning® 1430 Antifoam, although Dow Corning® AC-8016 Antifoam, Dow Corning® Q2-3302 Antifoam Compound, Dow Corning® Q2-3425 Antifoam Compound, Dow Corning® DSP Antifoam Emulsion, Dow Corning® BF20 PLUS Antifoam Emulsion, Dow Corning® 544 Antifoam Compound, Dow Corning® DB-310 Antifoam Compound, and Dow Corning® 1520 Silicone Antifoam along with any other similar industrial or food grade silicone defoamer find use in the present invention. These types of materials mentioned help reduce foaming in the rinse cycle of the laundry operation when incorporated in the fabric softener composition. Preferably the antifoam is present in the composition from about 0.001% to about 0.01% by weight.

2. Antimicrobial

Examples of antimicrobial agents that find use in the present invention include glutaraldehyde, formaldehyde, 2-bromo-2-nitropropane-1,3-diol sold under the trade name Bronopol®, 5-chloro-2-methyl-4-isothiazoline-3-one and 2-methyl-4-isothiazoline-3-one sold under the trade name Kathon®, and mixtures thereof. The preferred level for the antimicrobial is from about 0.001% to about 0.1%, or at that level recommended by the supplier of the particular antimicrobial and/or suggested in the supplier technical literature as that level required for optimally preserving aqueous surfactant compositions from mold and bacterial growth. The preferred antimicrobial for use in the present invention is glutaraldehyde and is best when incorporated from about 0.01% to about 0.10%. Most preferred in the present invention is to use Ucarcide® 250 brand of 50% glutaraldehyde solution and to add it at 0.050% by weight, based on the entire composition, resulting in an active level of glutaraldehyde of about 0.025%.

3. Fragrance

Fragrance is an optional ingredient for the concentrated fabric softener compositions of the present invention. For consumer acceptance, product recognition and recall, and most importantly to impart substantive fragrance to the fabrics inside the laundry washing machine, a fragrance is preferably added to the liquid fabric softener compositions of the present invention. Depending on the strength of the fragrance and the character of the perfume notes, the preferred amount of fragrance is from about 0.01% to about 3% by weight, based on the entire composition. Some preferred fragrances include, but are not limited to, UN063503/00, UN063507/00, UN063506/00, UN063511/00, UN063505/00, and UN063513/00 from Givaudan Fragrances, and Fressia-497 (from International Flavors and Fragrances).

4. Dyes

Dyes are optional ingredients within the compositions of the present invention. Dyes may comprise pigments, or other colorants, chosen so that they are compatible with the acidic pH of the final composition and such that the color is not attracted to the fabric. For example, a preferred colorant for use in the present invention is Liquitint® Green FS (from Milliken), at from about 0.001% to about 0.01% by weight, based on the entire composition. Other dyes such as C.I. Pigment Green #7, C.I. Reactive Green #12, F D & C Green #3, C.I. Acid Blue #80, C.I. Acid Yellow #17, Liquitint® Red MX, F D & C Yellow #5, Liquitint® Violet LS, Fast Turquise GLL, Liquitint® Blue MC, or mixtures thereof are also useful in the compositions of the present invention.

Example Fabric Softener Compositions and Methods for Manufacture

As mentioned above, the key ingredients required to produce a viscosity controlled, pourable concentrated fabric softener composition are, the quaternary surfactant (which is the actual softener and antistatic active material), the borate salt, the proton-donating agent and water. The preferred processing method to produce a stable fabric softener composition of the present invention, (to be described in detail below), is to add melted quaternary surfactant to a heated and stirred water solution (the so-called waterseat) comprising borate and proton-donating agent.

In accordance with an important aspect of the present invention, in order to provide a phase-stable aqueous laundry fabric softener composition, the pH of the waterseat should be adjusted and maintained in a range of between about 2.0 to about 5.0, preferably from about 2.5 to 4.5 and most preferably at about a pH of 3.0-3.5. Although adjusting the pH is very important, it has been unexpectedly found that it is important to have borate/proton-donating agent present in the waterseat as the pH buffer in order to regulate the viscosity of the final composition. Thus, it is important to not only lower the pH but to stabilize the pH in the above noted ranges with a borate/acid system so that the ultimate product is stable and no precipitation of complexes of the quaternary takes place for a lengthy period of storage. Preferably the waterseat of the present invention minimally is comprised of water, sodium tetraborate decahydrate and citric acid.

Following in TABLE 1 is a non-limiting example of a composition of a phase-stable liquid fabric softener made in accordance with the teachings of this invention:

TABLE 1

| Order | Ingredient | Wt. % actives |
|---|---|---|
| 1 | Water | 77.911% |
| 2 | Sodium tetraborate decahydrate | 0.200% |
| 3 | Citric Acid | 0.200% |
| 4 | Dow Corning ® 1430 Antifoam | 0.002% |
| 5 | Glutaraldehyde | 0.025% |
| 6 | Rewoquat ® WE-18-E-US ("Ester Quat" Quaternary) | 20.160% |
| 7 | Mountain Breeze Perfume Oil | 1.500% |
| 8 | Liquitint ® Green FS Dye | 0.002% |

The preferred order of addition is shown numerically in the left column of the table above. Specifically, the example composition was prepared by combining the water, sodium tetraborate decahydrate, citric acid, silicone antifoam and the glutaraldehyde into the batch tank and then heating the resulting aqueous mixture (the waterseat) to between 88° F. and 120° F. Then the melted quaternary surfactant (melted and held at about 105° F. to about 130° F.) is added to the heated waterseat. The fragrance oil is stirred in and is emulsified by the ester quat, (thus not requiring additional emulsifier). Lastly the dye is added. The resulting composition is viscous, yet creamy and lotion-like in appearance and is pourable.

TABLE 2 shows other combinations of dyes and fragrances that resulted in phase-stable, pourable concentrated liquid fabric softener compositions. In each example shown in TABLE 2, the base ingredients were the same as shown in TABLE 1. Only the dyes and fragrances were changed from the base formula above:

TABLE 2

| Composition | Designation | Dyes Used | Fragrances Used |
|---|---|---|---|
| 1 | Pink | Liquitint ® Red MX | Givaudan UN063503/00 |
| 2 | Mango | FD&C Yellow #5 and Liquitint ® Red MX | Givaudan UN063507/00 |
| 3 | Lilac | Liquitint ® Violet LS | IFF Fressia 497 |
| 4 | Cinnamon | FD&C Yellow #5 | Givaudan UN063506/00 |
| 5 | Yellow | FD&C Yellow #5 and Liquitint ® Red MX | Givaudan UN063511/00 |
| 6 | Green | Liquitint ® Green FS and Fast Turquoise GLL | Givaudan UN063505/00 |
| 7 | Blue | Liquitint ® Blue MC | Givaudan UN063513/00 |

While the present invention has been described above with reference to various exemplary embodiments and processing instructions, many changes, combinations and modifications may be made to the exemplary embodiments without departing from the scope of the present invention. For example, the various ingredients may be selected in alternate combinations. These alternatives can be suitably selected depending upon the particular application or in consideration of any number of factors associated with the stability and performance of the composition. In addition, the techniques described herein may be extended or modified for use with other types of formulations. These and other changes or modifications are intended to be included within the scope of the present invention.

We claim:

1. A liquid fabric softener composition comprising:

a. from about 1% to about 40% of an ester quat;

b. from about 0.01% to about 5% of a borate salt wherein said borate salt is selected from the group consisting of $Na_2O/2B_2O_3/1OH_2O$, $Na_2O/2B_2O_3/4H_2O$, $2CaO/3B_2O_3/5H_2O$:CaO, $Na_2O/2CaO/5B_2O_3/16H_2O$, and $5MgO/MgCl_2/7B_2O_3$;

c. from about 0.01% to about 1.0% of a proton-donating agent; and d. the balance water, wherein the pH of the final composition is between about 3.0 and 4.0.

2. The composition of claim 1 wherein said ester quat has the formula:

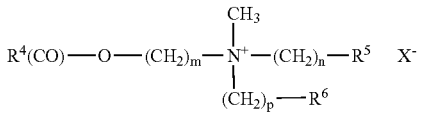

wherein $R^4$ is an aliphatic alkyl radical of 12 to 22 carbon atoms containing 0, 1, 2 or 3 double bonds; $R^5$ is H, OH or $O(CO)R^7$; $R^6$ is H, OH or $O(CO)R^8$ independently of $R^5$, with $R^7$ and $R^8$ each being independently an aliphatic alkyl radical of 12 to 22 carbon atoms containing 0, 1, 2 or 3 double bonds; m, n and p are each independently 1, 2 or 3, and $X^-$ is selected from the group consisting of halide, methyl sulfate, ethyl sulfate, acetate, nitrate, methyl phosphate or phosphate ion.

3. The composition of claim 1 wherein said proton-donating agent is selected from the group consisting of acetic acid, citric acid, malic acid, lactic acid, phosphoric acid, hydrochloric acid, and mixtures thereof.

4. The composition of claim 1 wherein the composition further comprises a silicone antifoam emulsion.

5. The composition of claim 1 wherein the composition further comprises an antimicrobial agent selected from the group consisting of glutaraldehyde, formaldehyde, 2-bromo-2-nitropropane-1,3-diol, 5-chloro-2-methyl-4-isothiazoline-3-one, 2-methyl-4-isothiazoline-3-one, and mixtures thereof.

6. The composition of claim 1 wherein the composition further comprises a dye.

7. A process for the preparation of the composition according to claim 1, wherein:

a. the borate salt and proton-donating agent are first dissolved in said water;

b. the resulting aqueous solution is heated to and held at between 88° F. and 120° F.;

c. the said ester quat is melted and held at between 105° F. and 130° F.; and d. the melted ester quat is added to the aqueous solution with stirring.

* * * * *